US009080522B2

(12) United States Patent
Spix et al.

(10) Patent No.: US 9,080,522 B2
(45) Date of Patent: Jul. 14, 2015

(54) ENGINE EFFICIENCY SYSTEM FOR A VEHICLE AND METHOD OF OPERATING AN ENGINE EFFICIENCY SYSTEM

(71) Applicant: GM GLOBAL TECHNOLOGY OPERATIONS LLC, Detroit, MI (US)

(72) Inventors: Thomas A. Spix, Rochester Hills, MI (US); Thomas M. Bishop, New Lothrop, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 383 days.

(21) Appl. No.: 13/649,614

(22) Filed: Oct. 11, 2012

(65) Prior Publication Data

US 2014/0107908 A1 Apr. 17, 2014

(51) Int. Cl.

| | |
|---|---|
| ***F01L 9/02*** | (2006.01) |
| ***F02D 41/00*** | (2006.01) |
| ***F02D 13/02*** | (2006.01) |
| ***F01M 9/10*** | (2006.01) |
| ***F01M 3/04*** | (2006.01) |

(52) U.S. Cl.

CPC . *F02D 41/00* (2013.01); *F01L 9/02* (2013.01); *F01M 3/04* (2013.01); *F01M 9/10* (2013.01); *F02D 13/0253* (2013.01)

(58) Field of Classification Search

CPC ..... F01L 9/02; F01M 3/04; F01M 9/10; F02D 13/0253

USPC ..... 701/103; 123/90.12, 90.15, 196 R, 123/196 M

See application file for complete search history.

(56) References Cited

U.S. PATENT DOCUMENTS

| | | | | |
|---|---|---|---|---|
| 2003/0226533 | A1* | 12/2003 | Fujiwara et al. | 123/90.17 |
| 2011/0277542 | A1* | 11/2011 | Traversa | 73/54.01 |
| 2014/0222313 | A1* | 8/2014 | Keller et al. | 701/103 |

FOREIGN PATENT DOCUMENTS

| | | | | |
|---|---|---|---|---|
| JP | 2001-59430 | * | 3/2001 | F02D 13/02 |

* cited by examiner

*Primary Examiner* — Hai Huynh

(74) *Attorney, Agent, or Firm* — Cantor Colburn LLP

(57) ABSTRACT

An engine efficiency system for a vehicle includes an electromechanically operated oil distribution device disposed proximate an oil environment of the vehicle. Also included is a current detection system for detecting a current change rate of the electromechanically operated oil distribution device, wherein the current change rate corresponds to a viscosity of an oil disposed in the oil environment of the vehicle. Further included is at least one efficiency device activated over a range of the viscosity of the oil.

17 Claims, 1 Drawing Sheet

ENGINE EFFICIENCY SYSTEM FOR A VEHICLE AND METHOD OF OPERATING AN ENGINE EFFICIENCY SYSTEM

FIELD OF THE INVENTION

The subject invention relates to vehicles, and more particularly to an engine efficiency system for a vehicle, as well as a method of operating such systems.

BACKGROUND

Vehicles are increasingly implementing various efficiency systems for numerous purposes. Two popular efficiency systems relate to emissions control and fuel economy, for example. Devices associated with such efficiency systems are typically programmed to operate during predetermined operating conditions, such as during predetermined conditions of oil employed in conjunction with the engine.

Typically, oil viscosity is a property of the oil that determines appropriate usage of the efficiency system device. Oil temperature is often used to serve as an indicator of oil viscosity; however, the use of specific sensors to determine oil temperature is costly and therefore the oil temperature is often estimated in an effort to optimize use of the devices associated with the efficiency systems. Unfortunately, estimation of the oil temperature may be inaccurate, with the inaccuracies typically more prevalent during certain operating stages, such as a transient warm-up phase of the engine, for example. There are additional sources of inaccuracies associated with estimating oil viscosity, such as age of the oil, oil weight actually installed, oil brand and fuel dilution, and water contamination, for example.

SUMMARY OF THE INVENTION

In one exemplary embodiment of the invention, an engine efficiency system for a vehicle includes an electromechanically operated oil distribution device disposed proximate an oil environment of the vehicle. Also included is a current detection system for detecting a current change rate of the electromechanically operated oil distribution device, wherein the current change rate corresponds to a viscosity of an oil disposed in the oil environment of the vehicle. Further included is at least one efficiency device activated over a predetermined range of the viscosity of the oil.

In another exemplary embodiment of the invention, a method of operating an engine efficiency system for a vehicle is provided. The method includes monitoring a current of an electromechanically operated oil distribution device with a current detection system. Also included is calculating a current change rate of the electromechanically operated oil distribution device. Further included is determining a viscosity of an oil corresponding to the current change rate. Yet further included is activating at least one efficiency device over a predetermined range of the viscosity of the oil.

The above features and advantages and other features and advantages of the invention are readily apparent from the following detailed description of the invention when taken in connection with the accompanying drawings.

BRIEF DESCRIPTION OF THE DRAWINGS

Other features, advantages and details appear, by way of example only, in the following detailed description of embodiments, the detailed description referring to the drawings in which.

DESCRIPTION OF THE EMBODIMENTS

Figure 1:
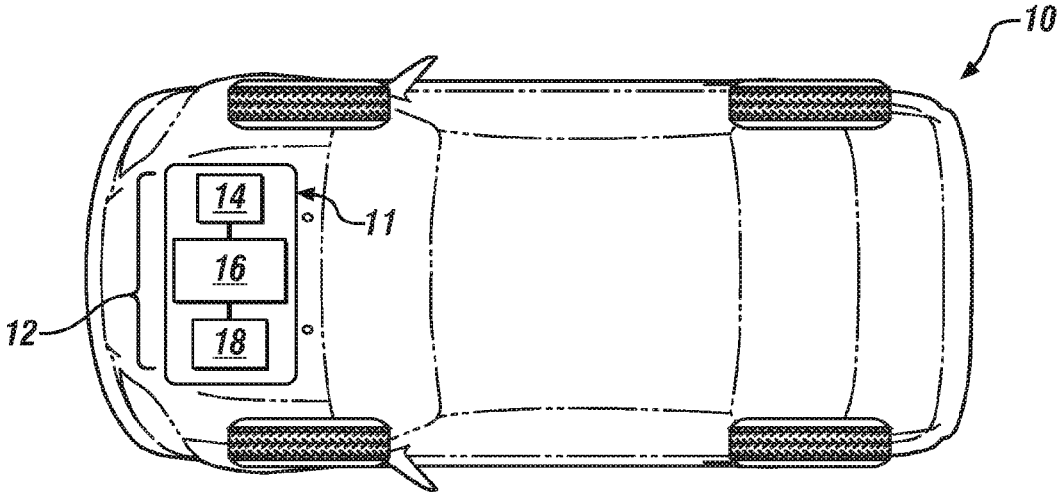
FIG. 1 is a schematic illustrating an engine efficiency system for a vehicle.

The following description is merely exemplary in nature and is not intended to limit the present disclosure, its application or uses. It should be understood that throughout the drawings, corresponding reference numerals indicate like or corresponding parts and features.

Referring to FIG. 1, in accordance with an exemplary embodiment of the invention, a vehicle is shown in the form of an automobile and is generally referred to with numeral 10. Although the vehicle 10 is illustrated as an automobile, it is to be appreciated that the embodiments disclosed herein may be employed in combination with various alternative types of vehicles. With respect to an automobile, it is to be further appreciated that the specific type of automobile is irrelevant to carrying out the embodiments described below. For example, the automobile may include a car, truck, sport utility vehicle (SUV) or van. The preceding list is merely illustrative and is not intended to be limiting of the numerous automobile types that may benefit from the embodiments of the invention.

The vehicle 10 includes an engine 11 and an engine efficiency system 12 that increases the efficiency of at least one operational aspect of the vehicle 10. One exemplary embodiment employs the engine efficiency system 12 to enhance fuel efficiency in a variety of manners. An additional embodiment employs the engine efficiency system 12 to provide greater control over emissions from the vehicle 10 during operation. Use of the engine efficiency system 12 to enhance fuel efficiency and/or control emissions are merely exemplary embodiments and it is to be understood that numerous other components or systems associated with the vehicle may be used in conjunction with the engine efficiency system 12 described herein. Engine efficiency devices may include a fuel efficiency system or an emissions control system, for example. Irrespective of the operational aspect that is benefitting from the engine efficiency system 12, oil is used to lubricate various components of an engine of the vehicle 10 during operation. The oil includes a number of properties that may vary based on the brand, grade, etc. During operation of the vehicle 10, the properties of the oil are modified based on the operating conditions of the vehicle, and more particularly the operating conditions of the engine. For example, during a time period close in proximity to ignition of the engine, the oil undergoes a transient warm-up phase. During this time, the oil is heated, thereby resulting in a temperature rise of the oil, as well as a change in viscosity of the oil. Various other operational conditions exist during operation of the engine that also result in modifications and transitions of the oil properties.

The engine efficiency system 12 includes various components that facilitate efficient distribution of the oil during operation of the vehicle 10. These components, as well as additional components that enhance efficiency are, at least in part, dependent upon properties of the oil. An illustrative, but not exhaustive, list of components that may be directly or indirectly dependent on oil properties include an oil pump, at least one cam phaser, a piston and a valve train.

An electromechanically operated oil distribution device 14 is disposed proximate an oil environment of the vehicle 10, where the oil discussed above is stored and distributed. Distribution of the oil is achieved by operation of the electromechanically operated oil distribution device 14, which typically includes an oil control valve that is formed of a solenoid and a valve. The electromechanically operated oil distribution device 14, and more specifically the oil control valve may be disposed in a number of locations proximate the oil environment, with one such location being within an oil pan. It is to be appreciated that any oil control valve could be employed, such as a cam phaser control valve, for example. A current detection system 16 is in operable connection with at least one component 18 of the electromechanically operated oil distribution device 14, such as the solenoid. The current detection system 16 is configured to monitor a current associated with the operation of the electromechanically operated oil distribution device 14. Rapid multiple current readings provide data on a current change rate of the electromechanically operated oil distribution device 14. The current detection system may include a controller and a current sensor, for example, where the controller and/or current sensor is configured to detect current and determine a rate of change of the current as a function of temperature.

Figure 2:
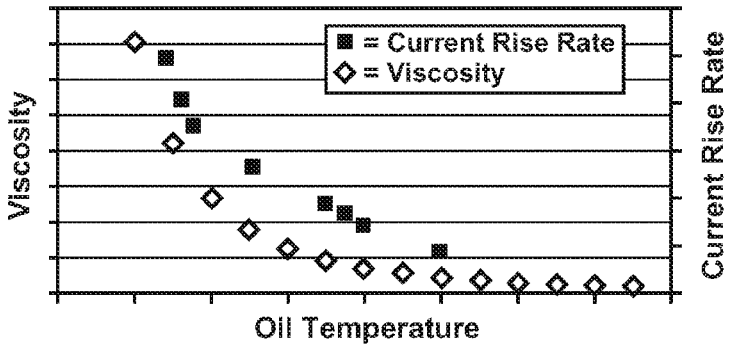
FIG. 2 is a plot illustrating a relationship between viscosity of an oil and a current rise rate of an electromechanically operated oil distribution device as a function of temperature within the engine efficiency system.

Referring now to FIG. 2, a plot illustrates a relationship between the current change rate of the electromechanically operated oil distribution device 14 and a viscosity of the oil. Such a relationship has been empirically determined to be a close relationship, with the current change rate being a strong indicator of oil viscosity. As described above, the at least one component 18 of the engine efficiency system 12 is dependent upon properties of the oil, with viscosity being an accurate property to base operation of the at least one component 18 of the engine efficiency system 12. It is shown that as the oil temperature increases, the viscosity decreases, however, a strict reliance on the relationship between oil temperature and oil viscosity may lead to unreliable viscosity predictions and therefore improper use of the one or more components of the engine efficiency system 12, as the oil may still be too viscous to enable appropriate usage of the engine efficiency system 12, which may cause premature engine wear or damage.

Advantageously, the engine efficiency system 12, and more specifically the at least one component 18 associated with efficiency enhancement, operates over a predetermined range of oil viscosity readings. The current detection system 16 provides an accurate measurement of viscosity of the oil that may be relied upon to operate the at least one component 18 over an optimal amount of the allowable predetermined range. By maximizing the operational range of the engine efficiency system 12, more efficient overall vehicle operation is achieved, while also avoiding premature operation of the engine efficiency system 12 which may result in undesirable outcomes, such as a service engine light initiation.

Figure 3:
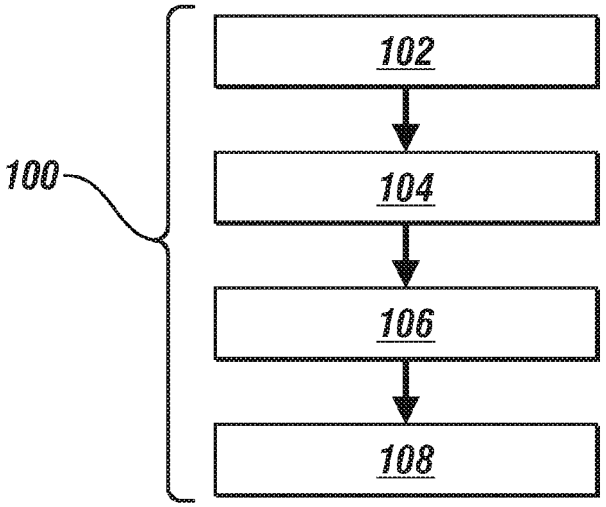
FIG. 3 is a flow diagram illustrating a method of operating the engine efficiency system.

A method of operating an engine efficiency system for a vehicle 100 is also provided as illustrated in FIG. 3 and with reference to FIGS. 1-2. The vehicle 10, and more specifically the engine efficiency system 12 have been previously described and specific structural components need not be described in further detail. The method of operating an engine efficiency system for a vehicle 100 includes monitoring a current of an electromechanically operated oil distribution device with a current detection system 102. A current change rate of the electromechanically operated oil distribution device 14 is calculated 104 to determine a viscosity of an oil 106 that corresponds to the current change rate of the electromechanically operated oil distribution device 14. At least one efficiency device is activated 108 over a predetermined range of the viscosity of the oil.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed, but that the invention will include all embodiments falling within the scope of the application.

What is claimed is:

1. An engine efficiency system for a vehicle comprising:
- an electromechanically operated oil distribution device disposed proximate an oil environment of the vehicle;
- a current detection system for detecting a current change rate of the electromechanically operated oil distribution device, wherein the current change rate corresponds to a viscosity of an oil disposed in the oil environment of the vehicle; and
- at least one efficiency device activated over a predetermined range of the viscosity of the oil.

2. The engine efficiency system of claim 1, wherein the electromechanically operated oil distribution device comprises an oil control valve comprising a solenoid and a valve.

3. The engine efficiency system of claim 2, wherein the current detection system determines the current change rate of the solenoid.

4. The engine efficiency system of claim 2, wherein the oil control valve is disposed proximate an oil pump.

5. The engine efficiency system of claim 2, wherein the oil control valve is disposed proximate at least one cam phaser.

6. The engine efficiency system of claim 2, wherein the oil control valve is disposed within an oil pan.

7. The engine efficiency system of claim 1, wherein the at least one efficiency device comprises a fuel efficiency system.

8. The engine efficiency system of claim 1, wherein the at least one efficiency device comprises an emissions control system.

9. A method of operating an engine efficiency system for a vehicle comprising:
- monitoring a current of an electromechanically operated oil distribution device with a current detection system;
- calculating a current change rate of the electromechanically operated oil distribution device;
- determining a viscosity of an oil corresponding to the current change rate; and
- activating at least one efficiency device over a predetermined range of the viscosity of the oil.

10. The method of claim 9, wherein the electromechanically operated oil distribution device comprises an oil control valve comprising a solenoid and a valve.

11. The method of claim 10, further comprising determining the current change rate of the solenoid with the current detection system.

12. The method of claim 10, wherein the oil control valve is disposed proximate an oil pump.

13. The method of claim 10, wherein the oil control valve is disposed proximate at least one cam phaser.

14. The method of claim 10, wherein the oil control valve is disposed within an oil pan.

15. The method of claim 9, wherein the at least one efficiency device comprises a fuel efficiency system.

16. The method of claim 9, wherein the at least one efficiency device comprises an emissions control system.

17. A vehicle comprising:

an engine; and an engine efficiency system for a vehicle comprising:

an electromechanically operated oil distribution device disposed proximate an oil environment of the vehicle;

a current detection system for detecting a current change rate of the electromechanically operated oil distribution device, wherein the current change rate corresponds to a viscosity of an oil disposed in the oil environment of the vehicle; and at least one efficiency device activated over a predetermined range of the viscosity of the oil.

* * * * *